US007685754B1

(12) United States Patent
Torres

(10) Patent No.: US 7,685,754 B1
(45) Date of Patent: Mar. 30, 2010

(54) STORM AND HURRICANE SIGNAGE

(76) Inventor: Rodrigo Torres, 1826 NE. 17th Ter., Cape Coral, FL (US) 33909

( * ) Notice: Subject to any disclaimer, the term of this patent is extended or adjusted under 35 U.S.C. 154(b) by 17 days.

(21) Appl. No.: 12/185,721

(22) Filed: Aug. 4, 2008

(51) Int. Cl.
*G09F 15/00* (2006.01)

(52) U.S. Cl. ..... 40/606.14; 40/602

(58) Field of Classification Search ..... 40/606.16, 40/602, 606.01, 612, 606.14, 473, 477, 479; 248/900, 468; 116/174, 63 P
See application file for complete search history.

(56) References Cited

U.S. PATENT DOCUMENTS

| | | | | | |
|---|---|---|---|---|---|
| 265,841 | A | * | 10/1882 | Marteeny | 40/479 |
| 1,250,064 | A | | 12/1917 | Whims | |
| 1,267,021 | A | | 5/1918 | Watts | |
| 2,165,704 | A | | 7/1939 | Hood | |
| 2,800,734 | A | * | 7/1957 | Blackburn | 40/602 |
| 3,162,847 | A | * | 12/1964 | Huffman | 340/601 |
| 4,353,179 | A | | 10/1982 | Jennings | |
| 4,498,657 | A | | 2/1985 | Werner | |
| 4,503,631 | A | | 3/1985 | Kelly | |
| 4,951,407 | A | * | 8/1990 | Werner | 40/608 |
| 4,972,614 | A | * | 11/1990 | Hector | 40/479 |
| 4,991,335 | A | | 2/1991 | Krautsack | |
| 5,437,409 | A | * | 8/1995 | Coushaine | 232/39 |
| 6,665,968 | B2 | * | 12/2003 | Jen | 40/601 |
| 2009/0072115 | A1 | * | 3/2009 | Worley | 248/548 |

FOREIGN PATENT DOCUMENTS

| | | |
|---|---|---|
| EP | 0348.723 | 1/1990 |
| FR | 2840629 | 12/2003 |
| JP | 2001348821 | 12/2001 |
| WO | WO92/00864 | 1/1992 |

* cited by examiner

*Primary Examiner*—Joanne Silbermann
*Assistant Examiner*—Kristina Staley
(74) *Attorney, Agent, or Firm*—Michael I Kroll

(57) ABSTRACT

A wind resistant sign enabled with a release mechanism providing for the sign pivoting from a starting point about an axis when the sign is exposed to a user determined threshold wind speed and a mechanism for returning the sign to its starting point when the wind speed decreases below the threshold. The sign pivot is the sign support and can be horizontal or vertical. The sign release mechanism can be as simple as a frangible locking element which is broken under sufficient wind velocity, a lock requiring a human operator to open, a lock controlled by a sensor, such as an anemometer, or a locking element responsive to a radio signal from a remote location. The return mechanism can be as simple as a spring for small signs, or a torque unit, such as a motor, for signs up to hundreds or thousands of kilograms.

16 Claims, 11 Drawing Sheets

STORM AND HURRICANE SIGNAGE

BACKGROUND OF THE INVENTION

1. Field of the Invention

The present invention relates generally to signage and, more specifically, to a sign enabled with a release mechanism providing for the sign pivoting from a starting point about an axis when sufficient air velocity is applied to the sign and a mechanism for returning the sign to its starting point when the air velocity decreases below a threshold.

The sign pivot is the sign support that can be in a horizontal or vertical orientation. The sign release mechanism can be as simple as a frangible locking element which is broken under sufficient wind velocity, a lock requiring a human operator to open, a lock controlled by a sensor, such as an anemometer, or a locking element responsive to a radio signal from a remote location. The return mechanism can be as simple as a spring for small signs, or a torque unit, such as a motor, for signs up to hundreds or thousands of kilograms.

The present invention further provides a sign design having an aerodynamic form, somewhat similar to an airplane wing, having a bulbous edge tapering to a smaller edge so that the bulbous edge creates eddy currents preventing the sign from fluttering in the wind.

The aerodynamic sign, of any dimensions, works in concert with the aforementioned release and return mechanisms provides signage that will inhibit wind damage, allowing said sign a means of self preservation from being ripped down or out of the ground in high and hurricane wind environments.

Forming the sign portion is a rectangular structure having a thickness comparable to a fin with an evenly thinning thickness on either side, whereby in the forward thicker region a post is attached in a rotational manner, in this rotatable attachment a spring is set to a predetermined threshold to store applied force. Between the static in-ground post and rotational sign portion, two opposing collars having holes are provided which rotate against one another where said sign and post meet so that a wire or frangible element may be attached to lock the sign into a position, until a high enough applied torque on the sign causes the wire to break. In the case of high winds sufficient enough to break the wire the present invention will lift and turn into the wind like a rudder until the stored torque in the spring can return it back into place.

2. Description of the Prior Art

There are other sign devices designed for high wind and storm environments. Typical of these is U.S. Pat. No. 1,250,064 issued to F. L. Whims on Dec. 11, 1917.

Another patent was issued to J. A. Watts on May 21, 1918 as U.S. Pat. No. 1,267,021. Yet another U.S. Pat. No. 2,165,704 was issued to J. B. Hood on Jul. 11, 1939 and still yet another was issued on Oct. 12, 1982 to Jennings as U.S. Pat. No. 4,353,179.

Another patent was issued on Feb. 12, 1985 as U.S. Pat. No. 4,498,657. Yet another U.S. Pat. No. 4,503,631 was issued to Kelly on Mar. 12, 1985. Another was issued to Krautsack on Feb. 12, 1991 as U.S. Pat. No. 4,991,335 and still yet another was issued on Aug. 28, 1990 to Werner as U.S. Pat. No. 4,951,407.

Another patent was issued to Frankland on Jun. 6, 1989 as European Patent No. EP0348723. Yet another PCT Patent No. WO9200864 was issued to Hjelm on Jan. 23, 1992. Another was issued to Kunio on Dec. 21, 2001 as Japanese Patent No. JP 2001348821 and still yet another was issued on Dec. 12, 2003 to Molodo as French Patent No. FR2840629.

U.S. Pat. No. 1,250,064

Inventor: F. L. Whims

Issued: Dec. 11, 1917

A device of the class described comprising a base, a sectional standard removably mounted thereon, said standard comprising a plurality of contacting sections provided with openings therethrough, a top section having a socket therein and a restricted opening adapted to align with the openings of the other sections, a flexible element extending through said openings, a thimble slidably mounted within said socket and connected to said flexible element, a resilient element interposed between said thimble and the lower wall of the socket and means for engaging the other end of the flexible element to secure the sections to the base under tension.

U.S. Pat. No. 1,267,021

Inventor: J. A. Watts

Issued: May 21, 1918

In a construction of the class described a base having a relatively large bottom and having upwardly and inwardly extending sides terminating in a relatively large opening in the top thereof, substantially above the plane of the bottom of the base, an indicating device, and flexible means for mounting said device upon said base substantially in the plane of the bottom and extending freely through the opening in the top of said base and normally out of contact with said top, the sides protecting the lower portion of the flexible means.

U.S. Pat. No. 2,165,704

Inventor: J. B. Hood

Issued: Jul. 11, 1939

In a sign structure, a base, a cup supported by said base, a resilient longitudinally split sleeve mounted interiorly of said cup, an upstanding coil spring having its lower end portion fitted within said sleeve, clamping means supported by the structure in a position to apply external pressure to said sleeve, and a sign element supported by said spring in a vertically spaced relation to said base.

U.S. Pat. No. 4,353,179

Inventor: Hugh F. Jennings

Issued: Oct. 12, 1982

A rotatable sign adapted to be driven by air currents to provide successively changing indicia to a viewer is disclosed. Indicia formed of light-reflective material and mounted on a dark background is located at different levels on at least two of three side panels of the sign to provide the illusion of a vertically moving sign. The rotatable portion of the sign can be inverted to reverse the direction of rotation.

U.S. Pat. No. 4,498,657

Inventor: William A. Werner

Issued: Feb. 12, 1985

A sign standard in which flexible means for permitting resilient lateral displacement of the sign is mounted closely below the sign, and means for adjusting the height of the sign above the ground, or other surface or a base, is disclosed.

U.S. Pat. No. 4,503,631

Inventor: Gerard T. Kelly

Issued: Mar. 12, 1985

A blow-through pivotal sign for preventing damage to advertising structures are the like. The blow-through pivotal sign comprises a signboard attached to a support structure to allow the signboard to rotate along a horizontal or vertical axis. The blow-through pivotal sign also comprises a mechanism for retaining the signboard in a fixed position until a preselected torque due to windload is applied as well as a wind responsive retractor for retracting the retaining mechanism to prevent damage thereto after the signboard has been deflected from the fixed position and is swinging freely.

U.S. Pat. No. 4,991,335

Inventor: Richard G. Krautsack

Issued: Feb. 12, 1991

A triangular mobile has a pair of substantially identical non-creased walls connected with each other and a creased wall connected along fold-lines to the non-creased walls. A triangular plug is pivotally attached to one of the non-creased walls to be pivoted into engagement with a foldable stop carried by the other of the non-creased walls and the creased wall to support the triangular mobile in an open display position. The triangular plug includes a hanger for suspending the triangular mobile from an overhead support.

U.S. Pat. No. 4,951,407

Inventor: William A. Werner

Issued: Aug. 28, 1990

A sign stand for supporting signs in windy environments includes a base, a staff portion extended from the base and an upper portion for receiving and displaying a sign. The sign stand includes a mechanism permitting pivoting of the sign to spill wind load and includes a mechanism for applying a restoring force to restore the sign to its normal vertical position on removal of the wind load. The restoring mechanism may be incorporated in the base structure and can utilize a tension spring to provide the restoring force.

European Patent Number EP0348723

Inventor: Nigel Howard Frankland et al.

Issued: Jun. 12, 1989

A rotatable sign has a base with a tubular housing containing bearings supporting a vertical shaft on which is mounted a display panel adapted to rotate when the wind blows. A knob can be rotated to drive a frictional element into contact with the shaft to retard the speed of rotation of the display panel.

International Patent Application Number WO92/00864

Inventor: Eric Hjelm

Published: Jan. 23, 1992

A triangular warning sign is mounted in a rotatable manner via a shaft in a foot, in that two side edges on the sign facing away from the foot are bent to provide flanges. The flanges face in mutually opposite directions, whereby the sign when used outdoors can be influenced by the wind and rotate. The sign thus becomes visible from all sides.

Japanese Patent Number JP2001348821

Inventor: Hiyama Kunio

Issued: Dec. 21, 2001

PROBLEM TO BE SOLVED: To solve problems that a road marker or the like is difficult to visually recognize since conventional signboards and various markers are fixed, and the markers are difficult to recognize since the display is made only on one side. SOLUTION: The signboards and road markers are not fixed, but freely fitted movably parallel to the wind. The road markers, etc., comprise a vertically connected wind-directive main plate and a sub plate fixed immediately below or above the main plate at a right angle thereto in a combined manner, and ends on the longitudinal axes of both plates are freely fitted to a pole or a stay around the pole. Same markers are provided on both sides of the road markers.

French Patent Number FR2840629

Inventor: Francois Modolo

Issued: Dec. 12, 2003

The road sign consists of a panel that is mounted asymmetrically on a single post and fitted with a spring-loaded doublehinge mechanism that returns the panel to its initial position after it has been deflected by a violent wind or an impact from a vehicle hitting the panel but not the post. In variants of the design the spring mechanism can be in the form of a torsion bar fitted inside the upper end of the post, or a spring-loaded upper post fitted inside a lower section set in the ground.

While these signs may be suitable for the purposes for which they were designed, they would not be as suitable for the purposes of the present invention, as hereinafter described.

SUMMARY OF THE PRESENT INVENTION

A primary object of the present invention is to provide an aerodynamic sign having a pivotal base to allow for a sign encountering high winds to turn into the wind to avoid being ripped out or damaged.

Another object of the present invention is to provide an aerodynamic sign having a profile shaped and acting like a fin or rudder in high winds.

Yet another object of the present invention is to provide an aerodynamic sign having a fixed post with a pivotal connection constructed with a spring to store any force used in turning the sign by the wind, so that it can be utilized in returning the sign back to its desired and set point.

Still yet another object of the present invention is to provide an aerodynamic sign having opposed collars with openings whereby a frangible wire or element may be secured to keep the sign fixed while encountering weak or small environmental forces.

Another object of the present invention is to provide an aerodynamic sign constructed in a shape and form resembling a flag so that it may turn into high winds to prevent being destroyed.

Yet another object of the present invention is to provide an aerodynamic sign having a rest position settable via a spring whereby the display of the sign can be set to a desired angle from the pole.

Additional objects of the present invention will appear as the description proceeds.

The present invention overcomes the shortcomings of the prior art by providing a sign having an aerodynamic form and pivotal spring bias, allowing said sign a means of self preservation from being ripped down or out of the ground in high and hurricane wind environments. Additionally the present invention has a side profile of a flag and top profile of a fin for aerodynamics required to direct the forward edge into the wind in the case of high force winds. Also a base that may be set to a desired angle and force thresholds of wind for turning of the sign is provided, utilizing the spring and/or a frangible wire.

The foregoing and other objects and advantages will appear from the description to follow. In the description reference is made to the accompanying drawing figures, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
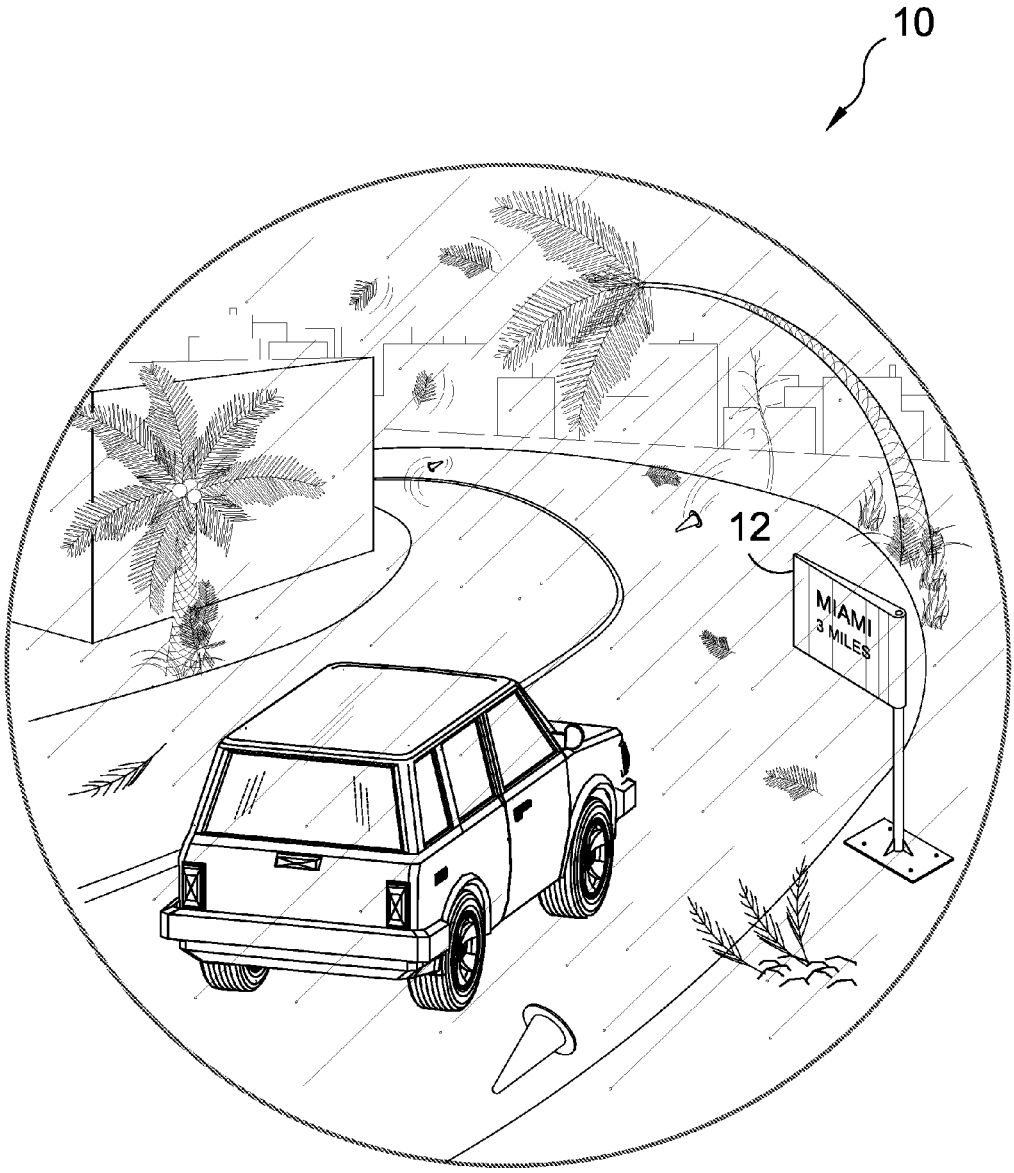
FIG. 1 is an illustrative view of the present invention in use.

Turning now descriptively to the drawings, in which similar reference characters denote similar elements throughout the several views, the figures illustrate the Wind Resistant Sign Support System of the present invention. With regard to the reference numerals used, the following numbering is used throughout the various drawing figures.

10 Wind Resistant Sign Support System of the present invention
12 storm sign
14 sign support
16 base of 14
18 sign support post
20 sign post
22 sign post collar
24 sign support collar
26 collar recess
28 frangible locking element
30 wire
32 spring
34 throughbore of 20
36 bolt lock
38 padlock
40 padlock aperture of 36
42 motorized bolt lock
44 receiver
46 signal
48 remote station
50 computer controlled device
52 anemometer
54 motorized return mechanism
56 return motor
58 large sign
60 pivoting end of 12
62 distal end of 12
64 aerodynamic edge of 12

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention is a wind resistant highway sign system 10 that responds to wind shear better than conventional signs by moving a storm sign 12 on a set spring like a flag moves in the wind, and will unlock the storm sign 12 at a predetermined wind speed, lifting the storm sign 12 on its springs until the wind reduces and then returns the sign 12 to its normal position.

Figure 2:
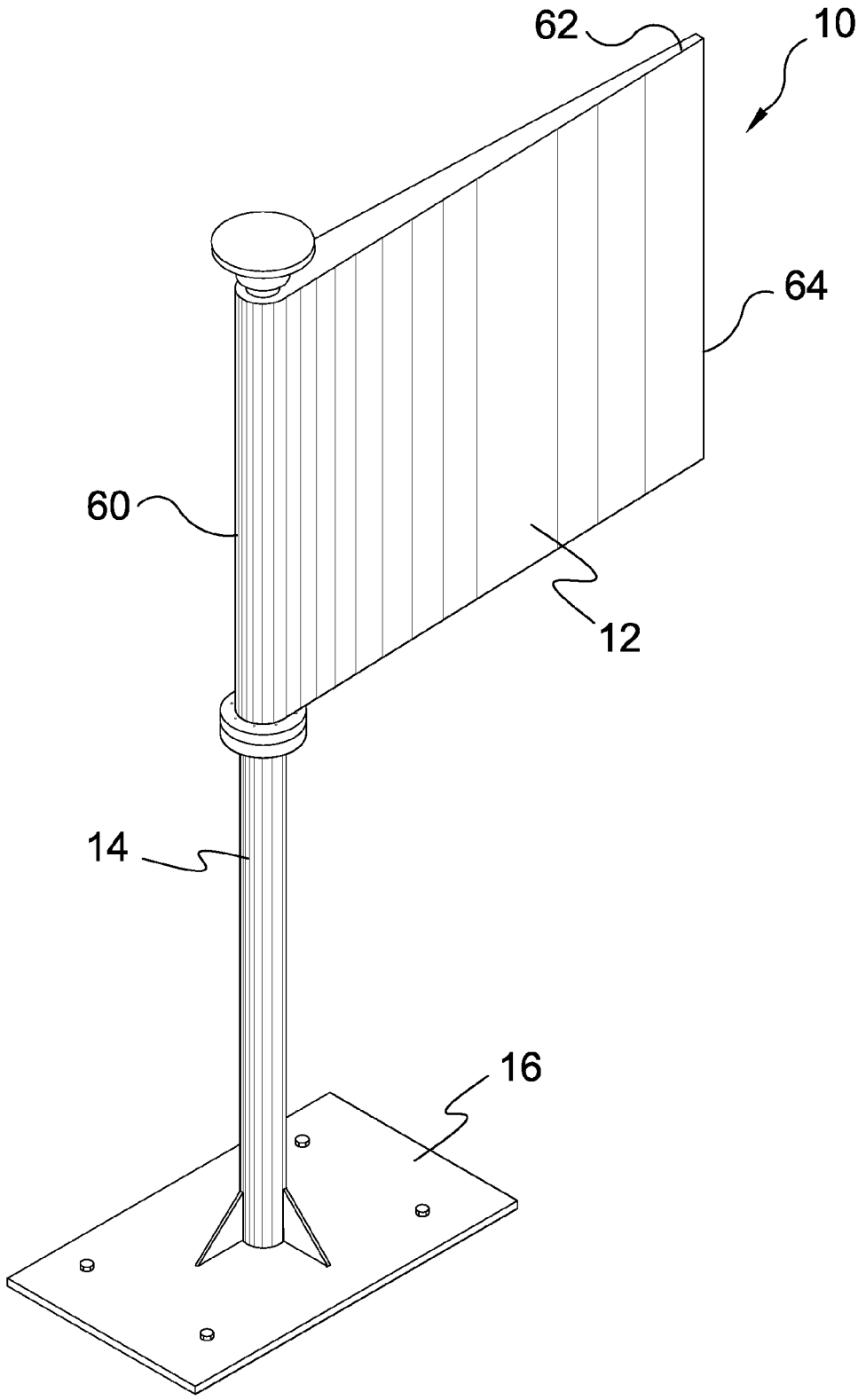
FIG. 2 is a perspective view of the present invention.

FIG. 2 is a perspective view of the present invention 10. Shown is the storm sign 12 pivotally mounted on a sign support post 14 secured to the ground by a base 16. The sign 12 has a thick pivoting end 60 that tapers to a thinner distal end 62 with an aerodynamic edge 64.

Figure 3:
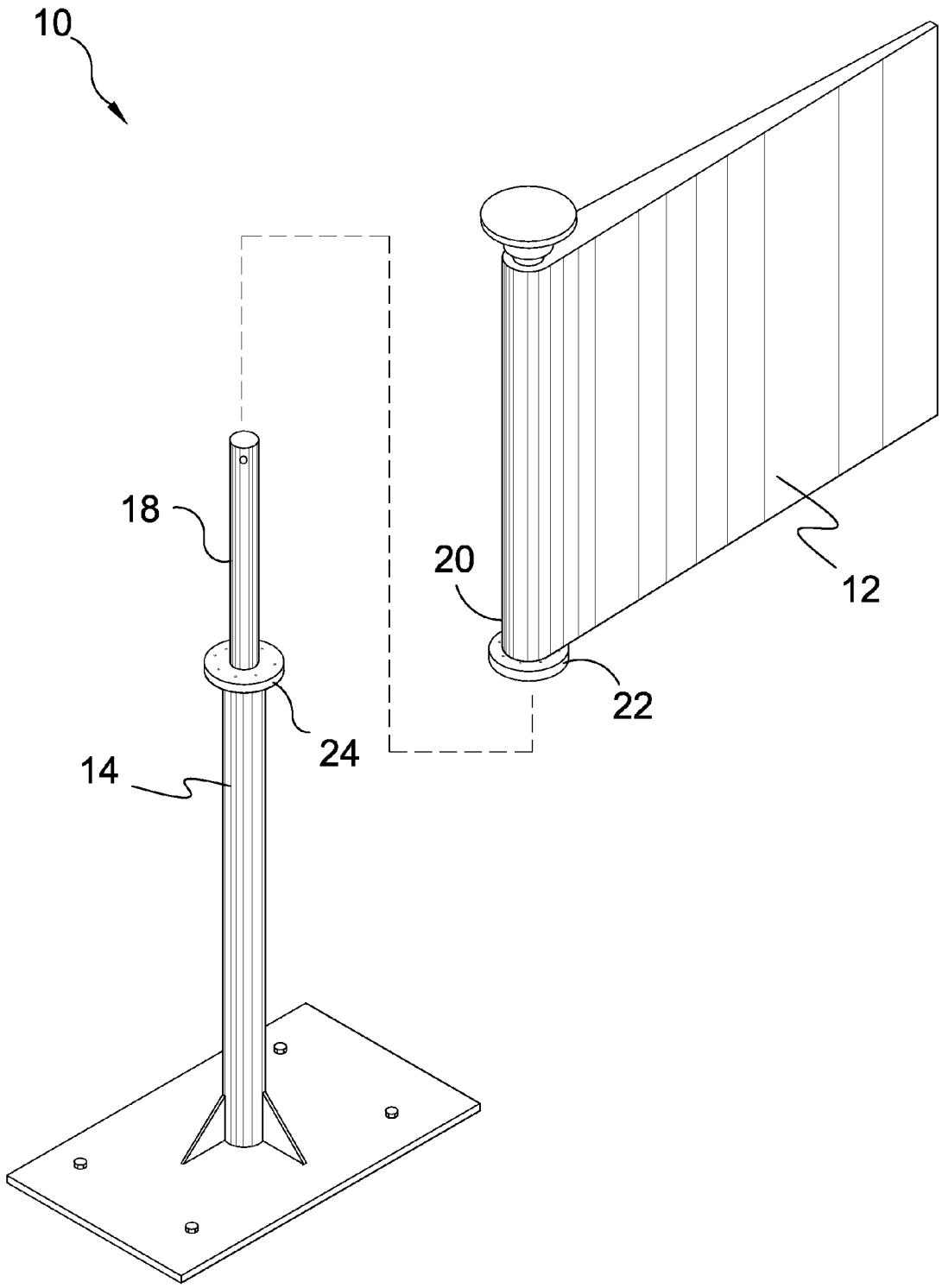
FIG. 3 is a detailed view of the present invention.

FIG. 3 is a perspective view of the storm sign 12 of the present invention 10. The sign support 14 has a sign support post 18 extending linearly therefrom that is insertable into a throughbore in the sign post 20 of the storm sign 12. The sign 12 has a sign post 20 with a collar 22 that is seated on an opposing sign support collar 24 when the sign support post 18 is inserted into the sign post 20.

Figure 4:
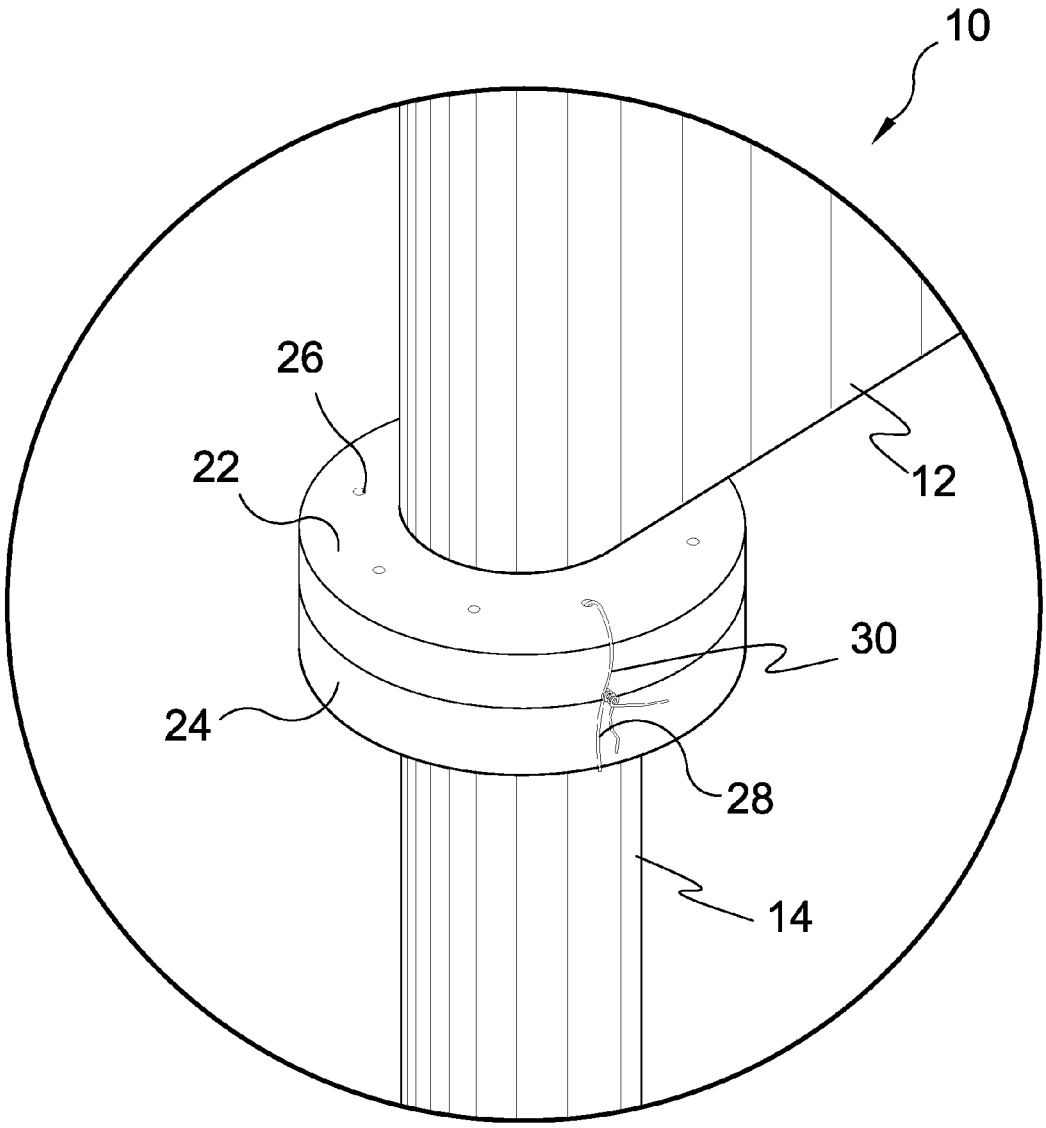
FIG. 4 is a detailed view of the present invention

FIG. 4 is a detailed view of the present invention 10. Shown is the sign post collar 22 seated and selectively positioned on the sign support collar 24 with each collar having a plurality of corresponding recesses 26. A frangible locking element 28, illustrated here as a wire 30 to maintain the static relationship between the sign 12 and the sign support 14 when windspeed remains below the preselected threshold.

Figure 5:
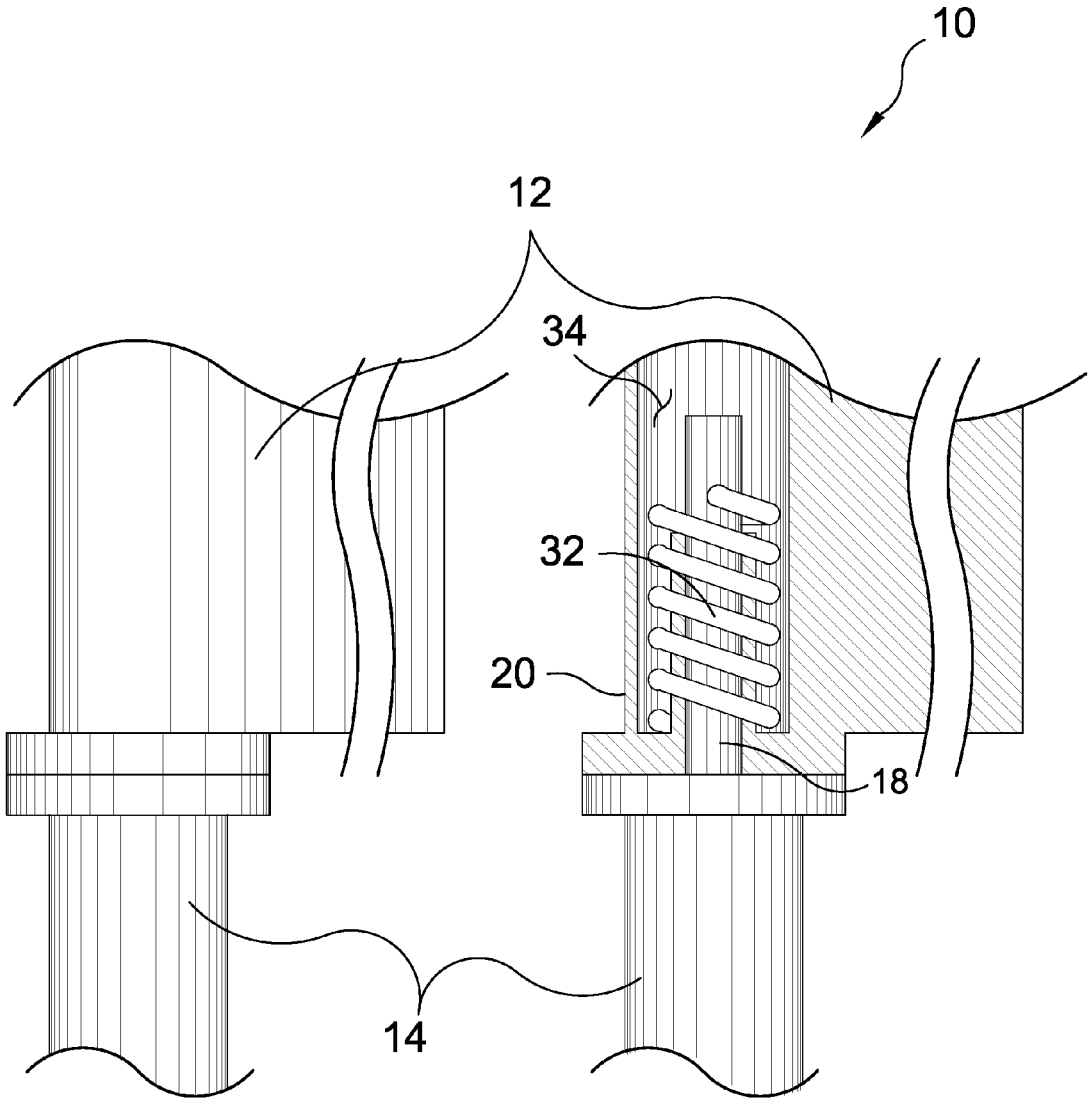
FIG. 5 is a perspective view of the present invention.

FIG. 5 is a sectional side view of the present invention 10. Shown is the sign 12 rotationally moveable on a set spring 32 coiled around the sign support post 18 within the sign post throughbore 34 sign post 20 that will unlock the sign 12 at a predetermined windspeed, lifting the sign 12 on its spring 32 until the wind reduces and then returns the sign 12 to its normal position relative to the sign support 14.

Figure 6:
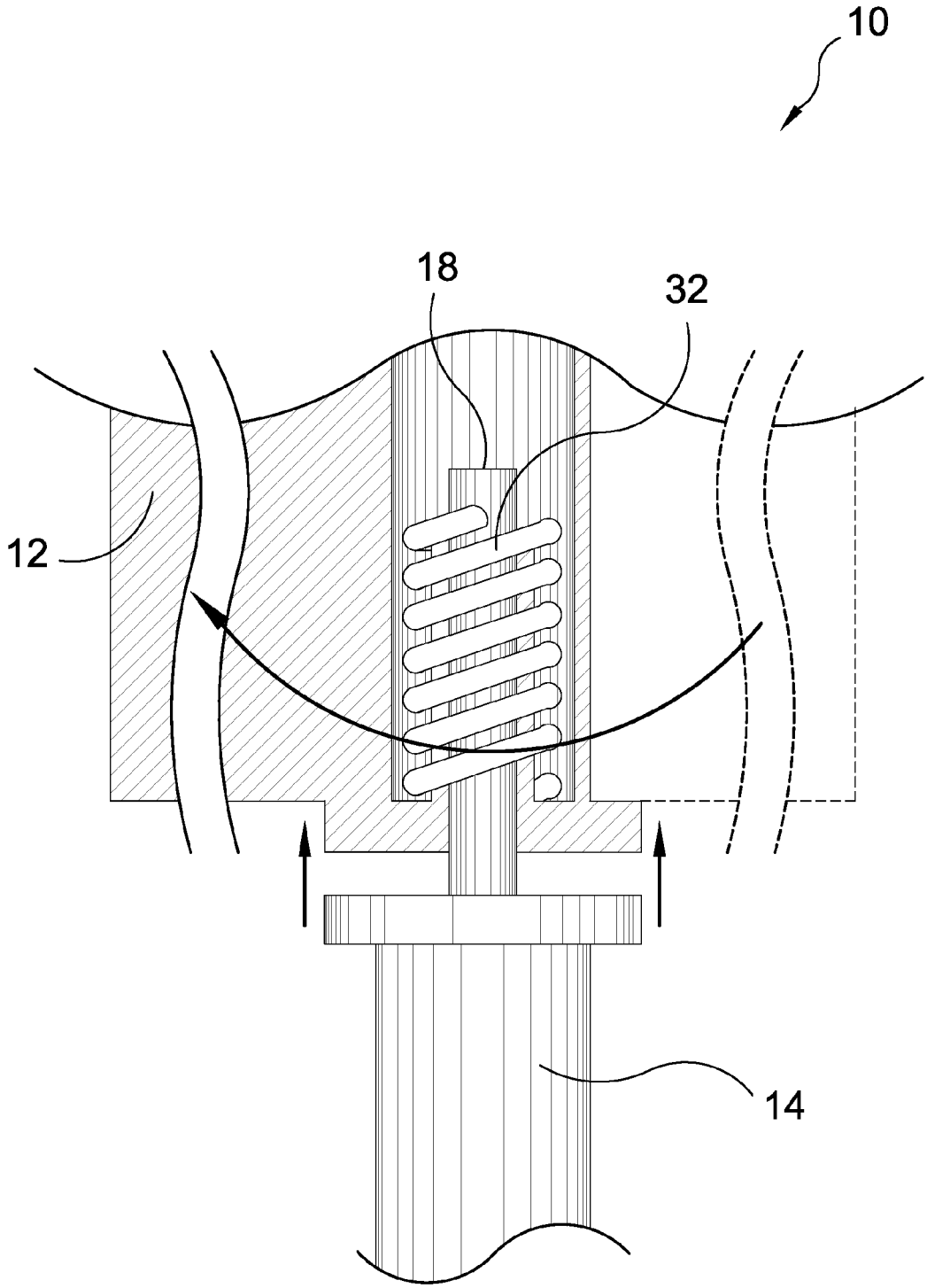
FIG. 6 is a perspective view of the present invention.

FIG. 6 is a side sectional view of the present invention 10. Shown is the sign 12 released due to excessive windspeed and rotating axially around the sign support post 18 to compress the spring 32 and apply rotational and downward forces to return the sign 12 to its original position relative to the sign support once the windspeed subsides to within the preselected user parameters.

Figure 7:
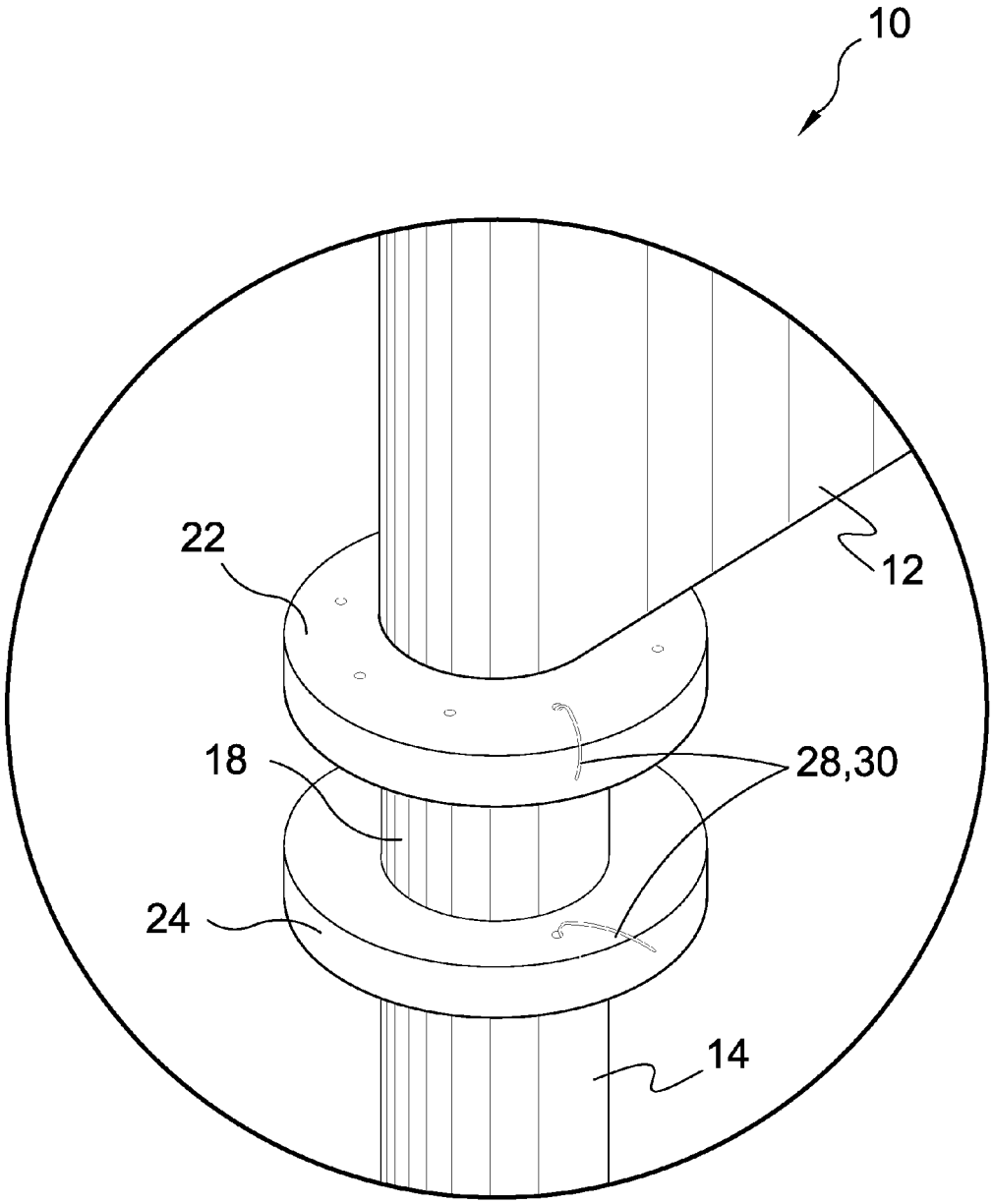
FIG. 7 is a partial side view of the present invention in normal position.

FIG. 7 is a detailed view of the present invention 10 in excessive windspeed conditions. Excessive windspeed pressure has been applied to the sign 12 according to the preselected parameters and compromised the wire 30 serving as a frangible locking element 28 retaining the sign post collar 22 to the sign support collar 24 to enable the sign 12 to rotate axially on the sign support post 18 of the sign support 14.

Figure 8:
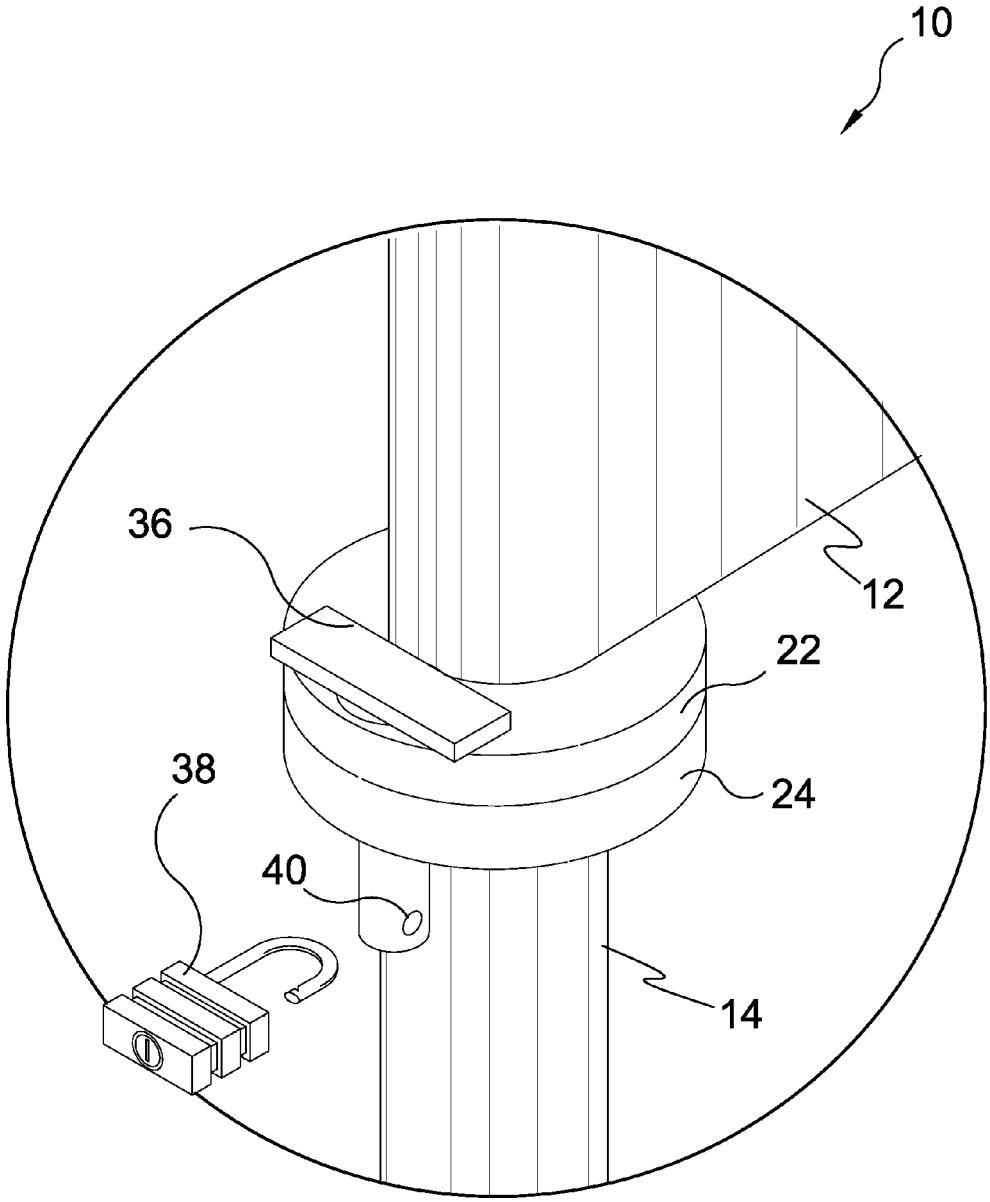
FIG. 8 is a partial side view of the present invention in windy condition.

FIG. 8 is a detailed view of the present invention 10 having an additional locking element. Shown is the sign post collar 22 and sign support collar 24 having mating collar recesses 26 for receiving a bolt lock 36 having a bolt lock aperture 40 to accept a padlock 38 to allow for manually enabling the rotation of the sign 12 relative to the sign support 14 by authorized personnel.

Figure 9:
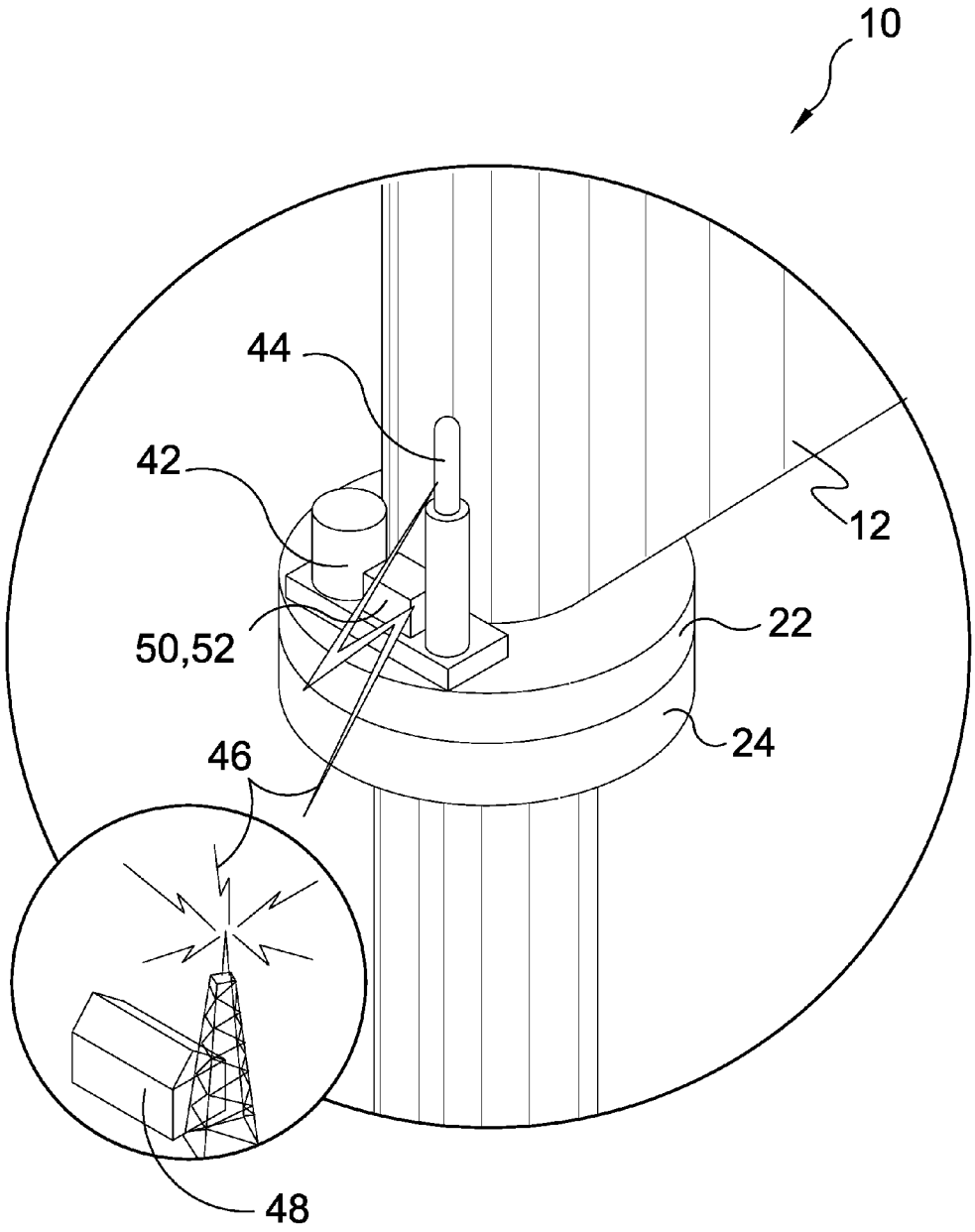
FIG. 9 is a partial side view of the present invention in windy condition.

FIG. 9 is a detailed view of the present invention 10 with an automated locking device. Shown is the sign post collar 22 and the sign support collar 22 secured with a motorized bolt lock 42 having a receiver 44 to receive a signal 46 from a remote station 48 to release the sign 12 from the static position. An on board computer control device 50 such as an anemometer 52 may be utilized to determine when the sign 12 should or should not be locked.

Figure 10:
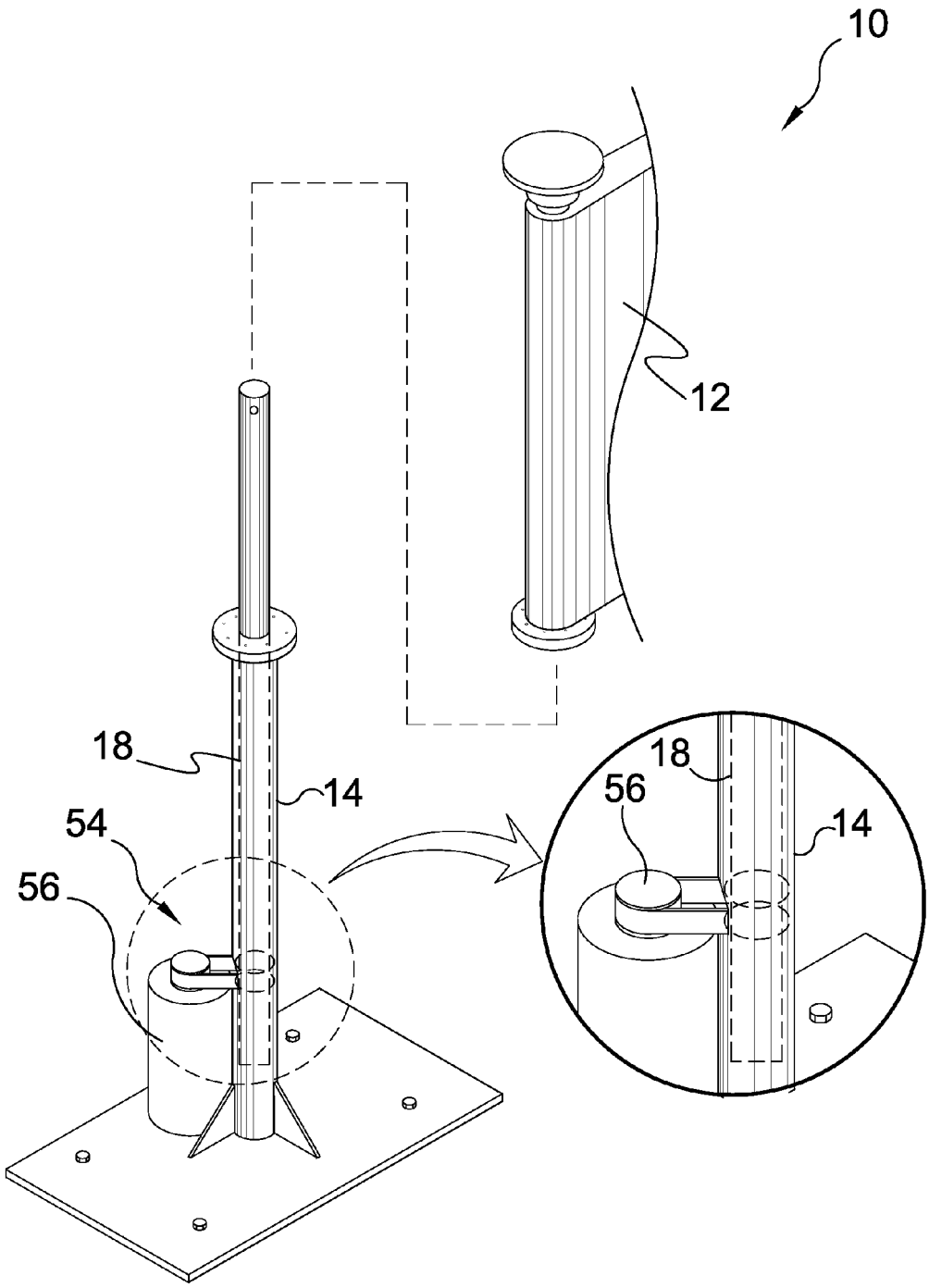
FIG. 10 is a perspective view of the present invention having a motorized return mechanism.

FIG. 10 is a perspective view of the present invention 10 having a motorized return mechanism. 54 wherein the sign support post 18 extends through the sign support 14 and is rotated by a return motor 56 to return large signs 58 to the position of origin in cases when the large sign 58 is too heavy to be returned back into place solely utilizing a spring based mechanism.

Figure 11:
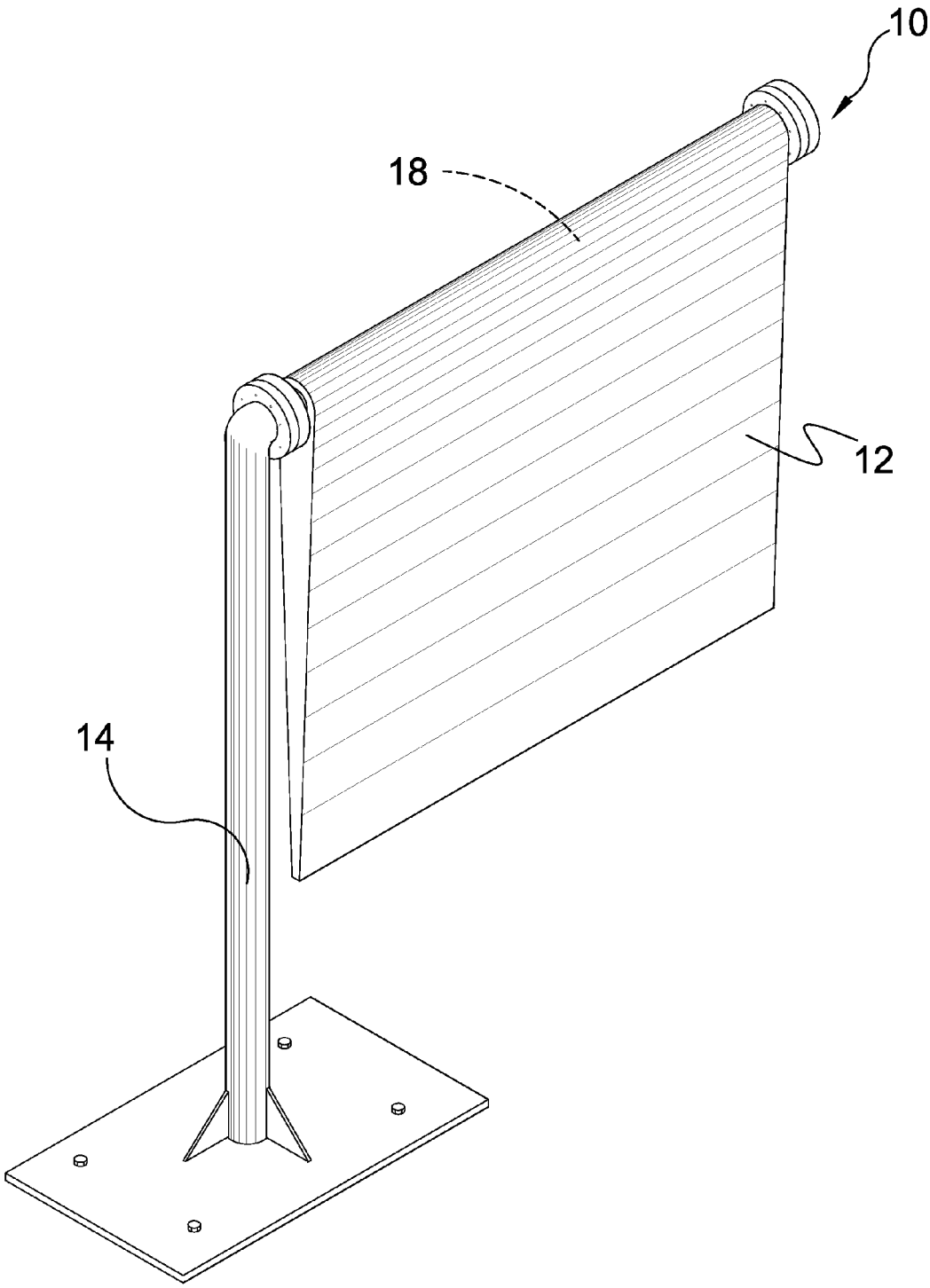
FIG. 11 is a detailed view of the present invention.

FIG. 11 is an additional element of the present invention. The sign 12 extends downward from a horizontal support post 18 projecting perpendicularly from a vertical sign support 14.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A wind resistant sign system comprising:

a) a linear sign support post with a first flange between opposite ends of said post;

b) a sign having a throughbore in and along one side edge thereof to engage a portion of said post on one side of said first flange, said throughbore having a second flange at one end thereof for contacting said first flange when said sign is in a resting position; and c) a spring within said throughbore having one end attached to said sign support post within said throughbore and an opposite end attached to a portion of said sign, and means for attaching said sign to said sign support post such that said sign is immovably attached in a fixed position to said sign support post when said sign is subjected to wind below a threshold windspeed and pivoting around said sign support post when said sign is subjected to wind above said threshold windspeed, said spring returning said sign to said resting position when windspeed subsides.

2. A wind resistant sign system according to claim 1, wherein said spring is a coil spring whereby pivoting of said sign causes said spring to separate said second flange from said first flange.

3. A wind resistant sign system according to claim 2, wherein said throughbore bus a cylindrical portion extending away from said second flange surrounding the portion of said support post extending into said throughbore, said spring wrapped around said cylindrical portion and extending past a free end of said cylindrical portion and attached at one end to said portion of said support post extending into said throughbore.

4. A wind resistant sign system according to claim 3, wherein a portion of said sign support post supporting said sign extends horizontally.

5. A wind resistant sign system according to claim 3, wherein said sign support post extends vertically.

6. A wind resistant sign system according to claim 3, wherein said means for attaching said sign to said sign support comprises a frangible member passing through aligned recesses in said flanges for connecting said flanges to each other.

7. A wind resistant sign system according to claim 6, wherein said frangible element comprises a wire looped through said recesses.

8. A wind resistant sign system according to claim 3, having means for locking said flanges together.

9. A wind resistant sign system according to claim 8, wherein said locking means comprises a padlock lock and a bolt member extending through aligned apertures in said first and second flanges engaged by said padlock.

10. A wind resistant sign system according to claim 8, wherein said locking means comprises a bolt lock actuated automatically by a sensor comprising an anemometer for detecting said threshold windspeed to unlock said flanges together.

11. A wind resistant sign system according to claim 8, wherein said locking means comprises a bolt lock actuated by a radio signal from a remote location to release said first and second flanges.

12. A wind resistant sign system according to claim 3, wherein said sign further comprises a distal free end opposite said pivoting edge, with said pivoting edge having a thickness greater than that of said distal free end.

13. A wind resistant sign system according to claim 12, wherein said sign tapers in thickness from said pivoting edge to said distal free end.

14. A wind resistant sign system according to claim 13, wherein said pivoting edge comprises a rounded, aerodynamic edge.

15. A wind resistant sign system according to claim 14, wherein said sign is generally rectangular in profile.

16. A wind resistant sign system comprising:

a) a flat base;

b) a cylindrical sign support extending up from said base, a top end of said sign support being open;

c) a sign support post with a first flange between opposite ends of said post extending into cylindrical sign support said through the top end with said first flange resting on said top end of said cylindrical sign support;

b) a sign having a throughbore in and along one side edge thereof engaging a portion of said post above said first flange, said throughbore having a second flange at a bottom end thereof for contacting said first flange;

c) a frangible wire passing through aligned recesses in said flanges for connecting said flanges to each other, said frangible wire releasing said flanges from each other when windspeed reaches a threshold value thereby allowing said sing to pivot around said cylindrical sign support;

c) a motor on said base adjacent to said cylindrical sign support; and d) means for connecting said motor to said post within said cylindrical sign support to return said sign to its initial position after said windspeed subsides.

* * * * *